US005998010A

United States Patent [19]

Schlueter, Jr. et al.

[11] Patent Number: 5,998,010

[45] Date of Patent: Dec. 7, 1999

[54] MIXED CARBON BLACK TRANSFER MEMBER COATINGS

[75] Inventors: Edward L. Schlueter, Jr.; Richard L. Carlston, both of Rochester; James F. Smith, Ontario, all of N.Y.

[73] Assignee: Xerox Corporation, Stamford, Conn.

[21] Appl. No.: 09/004,185

[22] Filed: Jan. 8, 1998

[51] Int. Cl.[6] ..... B41M 5/26

[52] U.S. Cl. ..... 428/323; 428/195; 428/206; 428/207; 428/423.1; 428/447; 428/473.5; 428/913; 428/914

[58] Field of Search ..... 428/195, 206, 428/207, 323, 913, 914, 423.1, 447, 473.5

[56] References Cited

U.S. PATENT DOCUMENTS

| | | | |
|---|---|---|---|
| 3,959,574 | 5/1976 | Seanor et al. | 428/425 |
| 4,673,618 | 6/1987 | Koshizuka et al. | 428/336 |
| 5,051,302 | 9/1991 | Tsuyguchi et al. | 428/323 |
| 5,064,509 | 11/1991 | Melnyk et al. | 204/9 |
| 5,454,980 | 10/1995 | Schlueter, Jr. et al. | 252/500 |
| 5,458,937 | 10/1995 | Nakamura et al. | 428/36.91 |

FOREIGN PATENT DOCUMENTS

| | | |
|---|---|---|
| 0 609 038 A2 | 8/1994 | European Pat. Off. . |
| 0 609 038 A3 | 8/1994 | European Pat. Off. . |
| 63-311263 | 12/1988 | Japan . |
| 8-234 544A | 9/1996 | Japan . |
| 8-334995 | 12/1996 | Japan . |
| 9-179420 | 7/1997 | Japan . |
| 9-258577 | 10/1997 | Japan . |

*Primary Examiner*—Bruce Hess
*Attorney, Agent, or Firm*—Annette L. Bade

[57] ABSTRACT

A transfer member comprising a polymer and a mixture of more than one variety of carbon black.

21 Claims, 4 Drawing Sheets

MIXED CARBON BLACK TRANSFER MEMBER COATINGS

CROSS REFERENCE TO RELATED APPLICATIONS

Attention is directed to copending U.S. patent application Ser. No. 09/005,175, filed Jan. 8, 1998, entitled, "Mixed Carbon Black Fuser Coatings." The disclosure of this application is hereby incorporated by reference in its entirety.

BACKGROUND OF THE INVENTION

The present invention relates to coatings comprising a polymer and a mixture of carbon blacks as resistive fillers. The mixture of carbon blacks comprises more than one or at least two different varieties or types of carbon black. Additional fillers can be used in addition to the mixture of carbon blacks. The coatings allow for tailoring of resistivity for use of the coatings in components useful in xerographic, including digital, processes. In preferred embodiments, the coatings are useful as coatings for intermediate transfer components or biasable transfer components, and more specifically, transfer components useful in transferring a developed image in an electrostatographic, especially xerographic machine or apparatus. In embodiments, the present coatings allow for the preparation and manufacture of coated components having excellent electrical, chemical and mechanical properties, including resistivity tailored to a desired resistivity range and excellent conformability. Moreover, intermediate transfer components comprising the mixed carbon black coatings, in embodiments, allow for high transfer efficiencies to and from intermediates even for full color images, and can be useful in both dry and liquid toner development systems.

In a typical electrostatographic reproducing apparatus, a light image of an original to be copied is recorded in the form of an electrostatic latent image upon a photosensitive member and the latent image is subsequently rendered visible by the application of electroscopic thermoplastic resin particles which are commonly referred to as toner. The developed image is then transferred to a copy sheet, or alternatively, is transferred to an intermediate transfer sheet prior to transfer to a copy sheet. The subsequently transferred image is permanently fused to the copy sheet by moving the copy sheet between a heated fusing member in pressure contact with a pressure member.

An important aspect of the transfer process in the electrostatographic process focuses on maintaining the same pattern and intensity of electrostatic fields as on the original latent electrostatic image being reproduced to induce transfer without causing scattering or smearing of the developer material. This important and difficult criterion is satisfied by careful control of the electrostatic fields, which, by necessity, should be high enough to effect toner transfer while being low enough to not cause arcing or excessive ionization at undesired locations. These electrical disturbances can create copy or print defects by inhibiting toner transfer or by inducing uncontrolled transfer which can easily cause scattering or smearing of the development materials. Specifically, excessively high transfer fields can result in premature toner transfer across the air gap, leading to decreased resolution or blurred images. High transfer fields in the pre-nip air gap can also cause ionization, which may lead to loss of transfer efficiency, strobing or other image defects, and a lower latitude of system operating parameters. Conversely, in the post transfer air gap region or the so-called post-nip region at the photoconductor-copy sheet separation area, insufficient transfer fields can give rise to image dropout and may generate hollow characters.

Attempts at controlling the resistivity of intermediate transfer members have been accomplished by, for example, adding conductive fillers such as ionic additives and/or carbon black to the conformable layer.

U.S. Pat. No. 3,959,574 discloses controlling the resistivity of polyurethane coating on a biasable member by use of ionic additives incorporated into the polyurethane. Barium titanate is disclosed as a plasticizer used to control resistivity of the polyurethanes.

U.S. Pat. No. 5,454,980 discloses a method of making an electrically conductive polyurethane elastomer which may be used in a bias transfer member. The polyurethane elastomer may include inorganic pigments such as barium titanate therein.

U.S. Pat. NO. 5,064,509 discloses a process for preparing a multi-layered belt which includes a thermoplastic film forming polymer which may be comprised of polyurethane or prepolymers of polyimide and which may include conductive particles such as carbon black, graphite or titanium dispersed therein.

Generally, carbon additives tend to control the resistivities and provide somewhat stable resistivities upon changes in temperature, relative humidity, running time, and leaching out of contamination to photoconductors. However, the required tolerance in the filler loading to achieve the required range of resistivity has been extremely narrow. In other words, a small change in percentage of carbon black filler loading has lead to a large change in resistivity. This, along with the large "batch to batch" variation, leads to the need for extremely tight resistivity control. In addition, carbon filled polymer surfaces have typically had very poor dielectric strength and sometimes significant resistivity dependence on applied fields. This leads to a compromise in the choice of centerline resistivity due to the variability in the electrical properties, which in turn, ultimately leads to a compromise in performance.

Therefore, there exists an overall need for a coating which can be tailored to a specific resistivity and/or dielectric strength, and wherein a relatively small change in filler loading will not significantly affect the resistivity and/or dielectric strength.

The present invention, in embodiments, allows for tailoring of specific and desired resistivities in order to increase transfer efficiency and to decrease the above discussed problems in inefficient transfer. The present invention, in embodiments, solves the above problems by providing transfer members, including bias transfer members and intermediate transfer members, which comprise a polymer and a mixture of carbon blacks dispersed therein. The combination of polymer and mixture of different carbon blacks allows for sufficient tailoring of desired resistivities.

SUMMARY OF THE INVENTION

In accordance with the invention, there is provided: a transfer member comprising a polymer and a mixture of more than one variety of carbon black.

There is further provided: an apparatus for forming images on a recording medium comprising: a charge-retentive surface to receive an electrostatic latent image thereon; a development component to apply toner to said charge-retentive surface to develop said electrostatic latent image and to form a developed image on said charge retentive surface; a transfer component to transfer the developed image from said charge retentive surface to a substrate, wherein said transfer component comprises a polymer and a mixture of more than one variety of carbon black dispersed therein; and a fixing component.

The transfer members provided herein, the embodiments of which are further described herein, may be useful in both dry and liquid toner systems and may be useful in color and multicolor systems. The transfer members herein, in embodiments, allow for tailoring of desired resistivities.

BRIEF DESCRIPTION OF THE DRAWINGS

For a better understanding of the present invention, reference may be had to the accompanying figures.

DETAILED DESCRIPTION OF THE PRESENT INVENTION

Figure 1:
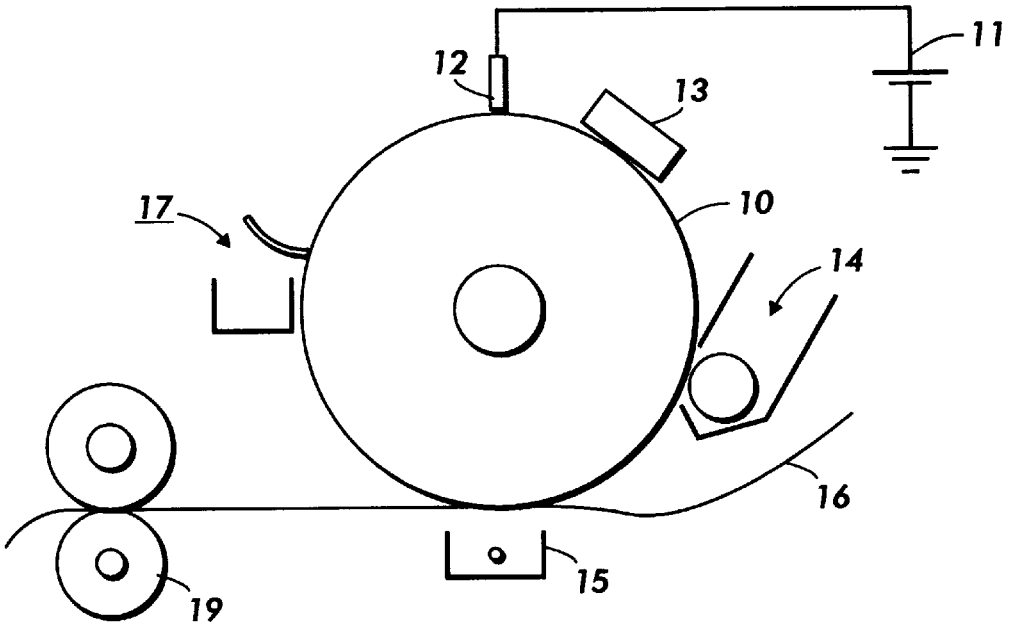
FIG. 1 is a schematic view of an electrostatographic reproducing apparatus including a transfer station.

Referring to FIG. 1, in a typical electrostatographic reproducing apparatus, a light image of an original to be copied is recorded in the form of an electrostatic latent image upon a photosensitive member and the latent image is subsequently rendered visible by the application of electroscopic thermoplastic resin particles which are commonly referred to as toner. Specifically, photoreceptor 10 is charged on its surface by means of a charger 12 to which a voltage has been supplied from power supply 11. The photoreceptor is then imagewise exposed to light from an optical system or an image input apparatus 13, such as a laser and light emitting diode, to form an electrostatic latent image thereon. Generally, the electrostatic latent image is developed by bringing a developer mixture from developer station 14 into contact therewith. Development can be effected by use of a magnetic brush, powder cloud, or other known development process. A dry developer mixture usually comprises carrier granules having toner particles adhering triboelectrically thereto. Toner particles are attracted from the carrier granules to the latent image forming a toner powder image thereon. Alternatively, a liquid developer material may be employed, which includes a liquid carrier having toner particles dispersed therein. The liquid developer material is advanced into contact with the electrostatic latent image and the toner particles are deposited thereon in image configuration.

After the toner particles have been deposited on the photoconductive surface, in image configuration, they are transferred to a copy sheet 16 by transfer means 15, which can be pressure transfer or electrostatic transfer. Alternatively, the developed image can be transferred to an intermediate transfer member and subsequently transferred to a copy sheet.

After the transfer of the developed image is completed, copy sheet 16 advances to fusing station 19, depicted in FIG. 1 as fusing and pressure rolls, wherein the developed image is fused to copy sheet 16 by passing copy sheet 16 between the fusing and pressure members, thereby forming a permanent image. Photoreceptor 10, subsequent to transfer, advances to cleaning station 17, wherein any toner left on photoreceptor 10 is cleaned therefrom.

Figure 2:
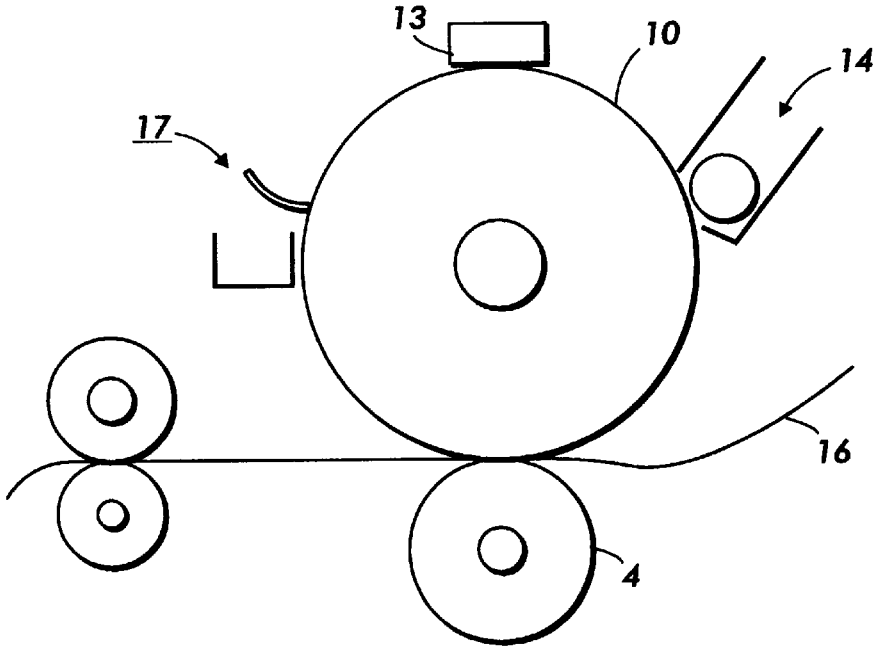
FIG. 2 is a schematic view of an electrostatographic reproducing apparatus including a bias transfer member.

FIG. 2 depicts an embodiment of the invention wherein transfer member is a bias transfer member 4. Transfer is effected by the physical detachment and transfer over of charged particulate toner material from a first image support surface (i.e., a photoreceptor 10) into attachment with a second image support substrate (i.e., a copy sheet 16) under the influence of electrostatic force fields generated by an electrically biased member 4. In this embodiment, an electrostatic charge is deposited on the copy sheet 16 by, for example, a bias transfer roll 4. Alternatively, transfer to the copy sheet 16 can be effected by spraying the charge on the back of the copy sheet 16.

In the transfer process, it is desirable to refrain from transferring any dry toner carrier or liquid carrier, depending on whether dry or liquid developer is being used, to the copy sheet 16. Therefore, it is advantageous to transfer the developed image to a coated intermediate transfer web, belt, roll or component, and subsequently transfer with very high transfer efficiency the developed image from the intermediate transfer component to a permanent substrate.

Figure 3:
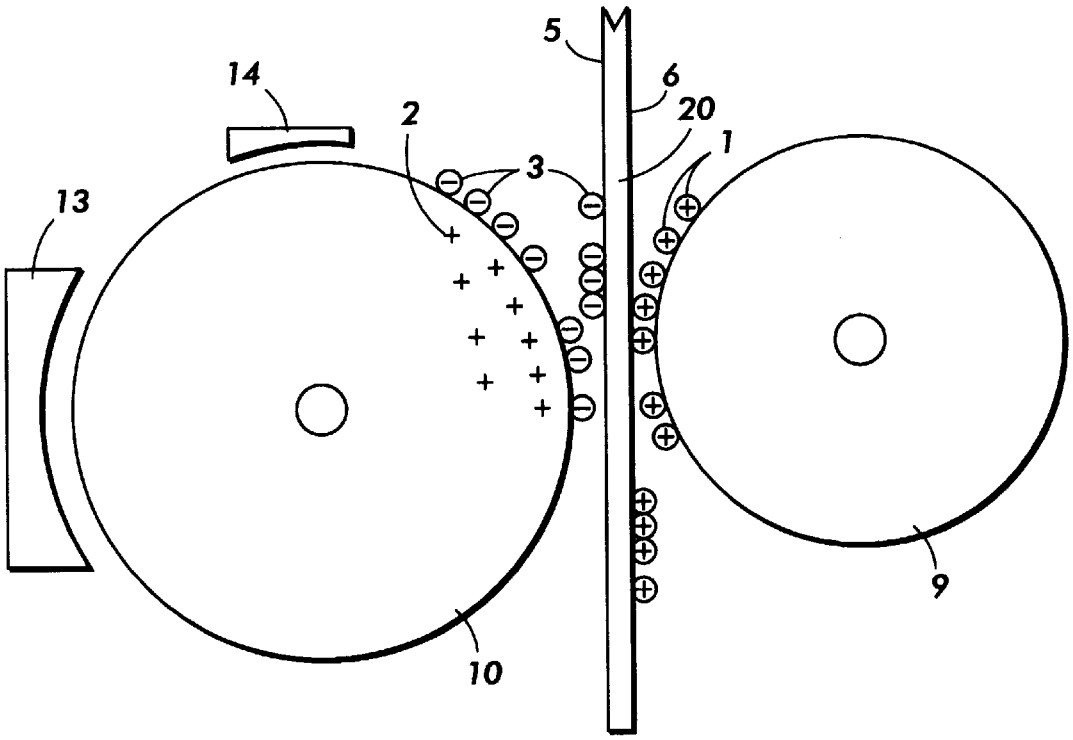
FIG. 3 depicts a sectional view of an intermediate transfer apparatus.

The use of an intermediate transfer member is especially applicable in the case of color systems and other multi-imaging systems. In a multi-imaging system such as that shown in FIG. 3, more than one image is developed. Each image is formed on the imaging drum 10 by image forming station 13. Each of these images is then developed at developing station 14 and transferred to intermediate transfer member 20. Each of the images may be formed on the photoreceptor drum 10 and developed sequentially and then transferred to the intermediate transfer member 20. In an alternative method, each image may be formed on the photoreceptor drum 10, developed, and transferred in registration to the intermediate transfer member 20.

More specifically, after latent image forming station 13 has formed the latent image on the photoreceptor drum 10 and the latent image of the photoreceptor has been developed at developing station 14, the charged toner particles 3 (depicted as negative particles in FIG. 3) from the developing station 14 are attracted and held by the photoreceptor drum 10 because the photoreceptor drum 10 possesses a charge 2 opposite to that of the toner particles 3. These charges can be reversed, depending on the nature of the toner and the machinery being used. In a preferred embodiment, the toner is present in a liquid developer. However, the present invention, in embodiments, is useful for dry development systems also.

A biased transfer member 9 (depicted as a roller in FIG. 3) positioned opposite the photoreceptor drum 10 has a higher voltage than the surface of the photoreceptor drum 10. Although the bias transfer member is depicted as a roller, it is understood that the bias transfer member can take other forms such as a film, belt, or the like. Biased transfer member 9 charges the backside 6 of intermediate transfer member 20 with a positive charge 1. In an alternative embodiment of the invention, a corona or any other charging mechanism may be used to charge the backside 6 of the intermediate transfer member 20.

The negatively charged toner particles 3 are attracted to the front side 5 of the intermediate transfer member 20 by the positive charge 1 on the backside 6 of the intermediate transfer member 20.

The transfer members of the present invention can be of several different configurations. The transfer member can take the form of a roll, film, sheet, belt, or other suitable configuration. The transfer member can have several configurations, such as a single layer configuration. If the transfer member is in the form of a sheet, belt, film or the like, the polymer may comprise the entire film, sheet, belt or the like. Alternatively, the film, sheet, belt or the like may comprise a substrate, and thereover, a polymer comprising a mixture of carbon blacks. There may include at least one, and preferably from about 1 to about 5 intermediate layers positioned between the substrate and the outer layer. The polymer/mixed carbon black layer can comprise any one of, more than one of, or all of the layers of the transfer member.

In the embodiments wherein the transfer member is in the form of a roll, the roll core may comprise the substrate. In a single layer configuration, the polymer/mixed carbon black coating will be bonded to the substrate. In an alternative embodiment, there may be included at least one, and preferably from about 1 to about 5 intermediate layers positioned between the outer layer polymer/mixed carbon black coating and the substrate.

Carbon black systems can be established to make polymers conductive. This is accomplished by either using more than one variety of carbon black, which means using carbon blacks with different particle geometries, carbon blacks with different resistivities, carbon blacks with different chemistries, carbon blacks with different surface areas, and/or carbon blacks with different particle sizes. Also, one variety of carbon black, or more than one variety of carbon black can be used along with other non-carbon black conductive fillers.

A mixture of carbon black comprising more than one, and preferably from about 2 to about 5 different varieties of carbon blacks, is dispersed in the polymer coating of the transfer member. Various forms (varieties) of carbon black can be used in the mixture, however, it is preferred to use a mixture of carbon blacks, wherein at least two of the carbon blacks have different characteristics, such as different particle size, different resistivity, different particle shape, surface area, chemistry and/or other different characteristics.

An example of using more than one variety of carbon black, each having at least one different characteristic from the other carbon black, includes mixing a high structured black like VULCAN® XC72 having steep resistivity slope, with a low structure carbon black such as REGAL 250R® having lower resistivities at increased filler loadings. The desired state is a combination of the two varieties of carbon black which yields a balanced controlled conductivity at relatively low levels of filler loading. This enables improved mechanical properties.

Another preferred mixer of carbon black comprises a carbon black or graphite having a particle shape of a sphere, flake, platelet, fiber, whisker, or rectangular used in combination with a carbon black or graphite with a different particle shape, to obtain optimum filler packing and thus optimum conductivities. For example, a carbon black or graphite having a spherical shape can be used with a carbon black or graphite having a platelet shape. In a preferred embodiment, a mixed ratio of carbon black or graphite fibers to spheres of approximately 3:1 is used.

Similarly, by use of relatively small particle size carbon blacks or graphites with relatively large particle size carbon blacks or graphite, the smaller particles "fit" into the packing void areas of the polymer substrate to improve particle touching. As an example, a carbon black having a relatively large particle size of from about 1 micron to about 100 microns, and preferably from about 5 to about 10 microns, and particularly preferred of from about 2 to about 10 microns, can be used in combination with a carbon black having a particle size of from about 1 submicron to about 1 micron, preferably from about 5 to about 100 submicrons.

In another embodiment, a preferred mixture of carbon black comprises a first carbon black having a dielectric constant of from about 50 to about 500K and a second carbon black having a dielectric constant of from about 4 to about 600 K.

Also, combinations of resistivities can be used to yield a shallow resistivity change with filler loading. For example, a carbon black or other filler having a resistivity of $10^{-1}$ to about $10^{3}$ ohms-cm, and preferably a resistivity of $10^{-1}$ to about $10^{2}$ ohms-cm can be used in combination with a carbon black or other filler having a resistivity of from about $10^{3}$ to about $10^{7}$ ohms-cm.

The filler particle size, shape, resistivity, and dielectric constant are selected and formulated to obtain the optimum packing factor for the final polymer/filler material function. Use of high oil absorption carbon blacks such as VULCAN® XC72 and KETJEN BLACK® which yield conductive polymer formulations with low filler loadings, provide conductivities which are hard to control during mixing, fabricating and cycling. At low loadings of fillers, these carbon blacks increase conductivity, modulus and compound viscosity. The spherical carbon blacks such as THERMAL BLACK® and REGAL 250R® are spherical particles with low oil absorption that require high loadings of filler to obtain the conductivity required. However, such low oil absorption carbon blacks exhibit a controlled and shallow resistivity slope with respect to filler loading. High loading of filler are required to obtain conductivity and high modulus with this type of carbon black. Ideally a mixture of the two varieties of carbon blacks is desired to obtain the optimum mechanical, electrical and chemical properties.

In addition, high surface area carbon blacks or graphites exhibiting high iodine or high oil absorption numbers (i.e., oil absorption numbers of from about 72 to about 350 cc/100 g, preferably from about 114 to about 330 cc/100 g) are suitable for use with low spherical carbon blacks which yield low iodine or low oil absorption numbers (i.e., absorption numbers of from about 10 to about 50 ml/100 g, preferably from about 30 to about 46 cc/100 g). Specific examples of combinations of high surface area carbon blacks or graphites with low spherical carbon blacks include use of high surface area carbon blacks such as VULCAN® XC72 and KETJEN BLACK® (absorption numbers of from about 174 to about 192 cc/100 g) can be used in combination with THERMAL BLACK® and REGAL 250R® (absorption numbers of from about 10 to about 46 cc/100 g) which are low spherical carbon blacks. The oil and iodine absorption numbers can be measured using typical ASTM particle absorption techniques. These are the types of blacks that are desired for combined filler systems. In a particularly preferred embodiment of the invention, KETJEN BLACK is used in combination with THERMAL BLACK®. In another embodiment, VULCAN® XC72 is used in combination with REGAL 250R®.

Another factor governing the packing factor in a mixed system is the Length to diameter ratio (L/D) and the ratios of the diameters of the particles. A preferred mixed carbon black system would be KETJEN BLACK® fibers with a L/D ratio of 10 and spherical THERMAL BLACK® with a sub micron particle size (0.5 u) and a L/D of 20. The maximum packing is approached when the ratio of diameters of the two fillers becomes large. A minimum packing factor for this system can be obtained for the above system with the diameter ratios being 3.

A first carbon black in an amount of from about 5 to about to about 80, and preferably from about 25 to about 75 percent by weight of total carbon black filler, is preferably used in combination with a second carbon black in an amount of from about 95 to about 20, and preferably from about 75 to about 25 percent by weight of total carbon black filler. In a preferred embodiment of the invention, an amount of from about 5 to about 80, and preferably from about 25 to about 75 percent by weight of total carbon black filler of high surface area or high oil absorption carbon blacks or graphites, is used in combination with from about 95 to about 20, and preferably from about 75 to about 25 percent by weight of total carbon black filler of low spherical or low oil absorption carbon blacks or graphites.

Examples of suitable carbon blacks and graphite include those commercially available from Southwestern Graphite of Burnet, Texas; KETJEN BLACK® from ARMAK Corp; VULCAN® XC72, VULCAN® XC72, BLACK PEARLS 2000, and REGAL® 250R available from Cabot Corporation Special Blacks Division; THERMAL BLACK® from RT Van Derbilt, Inc.; Shawinigan Acetylene Blacks available from Chevron Chemical Company; furnace blacks; ENSACO® Carbon Blacks and THERMAX Carbon Blacks available from R.T. Vanderbilt Company, Inc.; and GRAPHITE 56-55 (10 microns, $10^{-1}$ ohm-cm).

The transfer member may either take the form of an intermediate transfer member or a bias transfer member. In the embodiment wherein the transfer member is in the form of a flexible seamless or seamed belt, film or sheet, such as for example, an intermediate transfer member, the coating is present as a flexible film, sheet or belt made of plastic having a relatively high resistivity. Specific examples of suitable plastics include polyimides such as polyamideimide, polyimide, polyaramide, polyphthalamide; and other polymers such as polyphenylene sulfide, polyethylene naphalate, epoxies, acrylonitrile butadiene-styrenepolycarbonates (ABS), polyacrylics, polyvinylfluoride, polyethylene terephthalate (PET), polyetherether ketone (PEEK), and urethanes. Preferred urethanes include polyester, polyether, and polycaprolactone-based urethanes, available from Uniroyal, Bayer, Conap and others.

Specific examples of suitable plastics include polyimides having the tradename UPILEX®; such as UPILEX® S, available from ICI, Wilmington, Del.; KAPTON®, available from Dupont Company, Polymer Products Department, Industrial Films Division, Wilmington, Del.; KYNAR® such as KYNAR® 7201, available from El Atochem, North American Inc., Philadelphia, Pa. The plastic must be capable of exhibiting high mechanical strength, be flexible, and be resistive.

The transfer member may also take the form of a cylindrical roll, such as for example, a bias transfer member. In this embodiment, preferred polymers include urethanes such as those sold under the tradename VIBRATHANE®, such as VIBRATHANE® 6120, available from Uniroyal Chemical Company, Benson Rd., Middlebury, Conn.; urethanes sold under the tradename MULTRATHANE® from Bayer Corp., Pittsburgh, Pa.; urethanes sold under the tradename CONATHANE® from Conap Inc., Olean, N.Y.; and TERATHANE® products such as TERATHANE® 650, available from Barley Mill Plaza, Wilmington, Del., and the like. Silicone elastomers such as polydimethyl, polyphenyl, and fluorosilicone materials (HTVs (heat vulcanizable), LSR (liquid silicone rubber), heat curable via hydride addition cure reactions, and RTV (room temperature vulcanizable via condensation cure reactions)), those silicone elastomers available under the tradename ELEKTROGUARD®, available from Wacker Silicones Corp., Adrian, Mich.; those available from: Dow Corning Corp., General Electric Company, Waterford, N.Y.; Grace Specialty Polymers Co., Lexington, Mass.; and Wacker Silicones Corp., Adrian, Mich., are also useful as bias transfer member outer layers.

Other elastomer systems that are suitable for use herein include EPDM, nitriles and fluorocarbon elastomers. EPDMs are available from Bayer Rubber Division, Akron, Ohio; Exxon Chemical, Houston, Tex.; Dupont Dow Elastomers, Wilmington, Del.; and DSM Copolymer Inc., Baton Rouge, La., nitrile rubbers are available from Uniroyal Chemical Co. Inc., Middlebury, Conn. and Zeon Chemical Inc. Louisville, Ky. Fluorocarbon elastomers such as those available from Dupont Dow Elastomers, Wilmington, Del.; Ausimont Inc., Morristown, N.J.; Daikin Industries, Ltd., Tokyo, Japan; and Dyneon L.L.C. , Oakdale, Minn. are also useful. Preferred fluorocarbon elastomers include copolymers and terpolymers of vinylidenefluoride, hexafluoropropylene and tetrafluoroethylene, which are known commercially under various designations as VITON A®, VITON E®, VITON E60C®, VITON E45®, VITON E430®, VITON 910®, VITON GH®, VITON B50®, and VITON GF®. The VITON® designation is a Trademark of E.I. DuPont de Nemours, Inc. Other commercially available materials include FLUOREL 2170®, FLUOREL 2174®, FLUOREL 2176®, FLUOREL 2177® and FLUOREL LVS 76® FLUOREL® being a Trademark of 3M Company. Additional commercially available materials include AFLAS™ a poly(propylene-tetrafluoroethylene) and FLUOREL II® (LII900) a poly(propylene-tetrafluoroethylenevinylidenefluoride) both also available from 3M Company, as well as the Tecnoflons identified as FOR-60KIR®, FOR-LHF®, NM® FOR-THF®, FOR-TFS®, TH®, TN505® available from Montedison Specialty Chemical Company.

Two preferred known fluoroelastomers are (1) a class of copolymers of vinylidenefluoride, tetrafluoroethylene and hexafluoropropylene known commercially as VITON A® and (2) a class of terpolymers of vinylidenefluoride, hexafluoropropylene, and tetrafluoroethylene known commercially as VITON B®. VITON A® and VITON B®, and other VITON® designations are trademarks of E.I. DuPont de Nemours and Company.

In another preferred embodiment, the fluoroelastomer is a tetrapolymer having a relatively low quantity of vinylidenefluoride. An example is VITON GF®, available from E.I. DuPont de Nemours, Inc. The VITON GF® has 35 weight percent of vinylidenefluoride, 34 weight percent of hexafluoropropylene and 29 weight percent of tetrafluoroethylene with 2 weight percent cure site monomer. The cure site monomer can be those available from DuPont such as 4-bromoperfluorobutene-1, 1,1-dihydro-4-bromoperfluorobutene-1, 3-bromoperfluoropropene-1, 1,1-dihydro-3-bromoperfluoropropene-1, or any other suitable, known, commercially available cure site monomer.

In the embodiment wherein the coating is the substrate, and there is present a single film layer, single belt layer, single sheet layer, or the like, for the transfer member, the thickness of the coating is from about 0.05 to about 100 mils, preferably from about 0.5 to about 50 mils, and particularly preferred from about 1 to about 25 mils. The transfer member may comprise a substrate, and thereover, a coating. In an embodiment wherein the substrate is a film, belt, or sheet and an outer coating, the substrate has a thickness of from about 0.5 to about 5 mils, and the coating on a substrate such as a roll, belt, film, sheet, or other substrate, has a thickness of from about 0.01 to about 40 mils, preferably from about 0.5 to about 25 mils. The transfer member may also include one or more, and preferably from about 1 to about 5 intermediate layers, including adhesive layers. Optional intermediate adhesive layers and/or polymer layers may be applied to achieve desired properties and performance objectives of the present member. An adhesive intermediate layer may be selected from, for example, epoxy resins and polysiloxanes. Preferred adhesives are proprietary materials such as THIXON 403/404, Union Carbide A-1100, Dow TACTIX 740, Dow TACTIX 741, and Dow TACTIX 742. A particularly preferred curative for the aforementioned adhesives is Dow H41. Preferred adhesive(s) for silicone adhesion is A4040 silane available from Dow Corning Corp., Midland, Mich. 48686, equivalent adhesive/primers are D.C. 1200 also from Dow Corning and S-11 silane from Grace Specialty Polymers, Lexington, Mass. Adhesion of fluorocarbon elastomers is accomplished with Chemlok 5150 available from Lord Corp., Coating and Lamination Division, Eire, Pa.

The polymer is present in the coating in an amount of from about 40 to about 95 percent by weight of total solids, and preferably from about 60 to about 80 percent by weight of total solids. The filler carbon black mixture is preferably present in a total amount of from about 60 to about 5, and preferably from about 40 to about 20 percent by weight of total solids. Total solids as used herein refers to the total amount by weight of polymer, solvent, total carbon black fillers, optional metal fillers, and optional additives.

Other fillers, in addition to carbon blacks, can be added to the polymer and dispersed therein. Suitable fillers include metal oxides such as magnesium oxide, tin oxide, zinc oxide, aluminum oxide, zirconium oxide, barium oxide, barium titanate, beryllium oxide, thorium oxide, silicon oxide, titanium dioxide and the like; nitrides such as silicon nitride, boron nitride, and the like; carbides such as titanium carbide, tungsten carbide, boron carbide, silicon carbide, and the like; and composite metal oxides such as Zircon ($ZrO_2 \cdot Al_2O_3$), Spinel ($MgO \cdot Al_2O_3$), Mullite ($3Al_2O_3 \cdot 2SiO_2$), Sillimanite ($Al_2O_3 \cdot SiO_2$), and the like; mica; and combinations thereof. Optional fillers are present in the polymer/mixed carbon black coating in an amount of from about 20 to about 75 percent by weight of total solids, and preferably from about 40 to about 60 percent by weight of total solids.

It is preferred that the resistivity of the coating layer be from about $10^7$ to about $10^{13}$ ohms/sq, preferably from about $10^9$ to about $10^{12}$ ohms/sq, and particularly preferred about $10^9$ to about $10^{10}$ ohms/sq.

In another embodiment, a thin insulative layer of the polymer/carbon black mixture is used and has a dielectric thickness of from about 1 to about 10, and preferably 5 U.

The hardness of the polymer/carbon black mixture coating is preferably less than about 85 Shore A, more preferably from about 45 to about 65 Shore A, and particularly preferred from about 50 to about 60 Shore A.

The circumference of the component in a film or belt configuration of from about 1 to about 5 or more layers, is from about 8 to about 150 inches, preferably from about 10 to about 50 inches, and particularly preferred from about 15 to about 44 inches. The width of the film or belt is from about 8 to about 60 inches, preferably from about 12 to about 60 inches, and particularly preferred from about 15 to about 54 inches. It is preferably that the film be an endless, seamed flexible belt or a seamed flexible belt, which may or may not include puzzle cut seam(s). Examples of such belts are described in U.S. Pat. Nos. 5,487,707; 5,514,436; and U.S. patent application Ser. No. 08/297,203 filed Aug. 29, 1994, the disclosures each of which are incorporated herein by reference in their entirety. A method for manufacturing reinforced seamless belts is set forth in U.S. Pat. No. 5,409,557, the disclosure of which is hereby incorporated by reference in its entirety.

The layer or layers may be deposited on a substrate via a well-known coating processes. Known methods for forming outer layer(s) on a substrate film such as dipping, spraying such as by multiple spray applications of very thin films, casting, flow-coating, web-coating, roll-coating, extrusion, molding, or the like can be used. It is preferred to deposit the layers by continuous coating such as by multiple spray applications of very thin films, by web coating or by flow-coating.

In embodiments, the polymer/carbon black mixture coatings herein provide a substantially linear plot of conductivity versus filler loading. Specifically, linear conductivity of a material can be determined by preparing a plot of filler loading versus conductivity. The following explains one procedure for developing such a linear plot. Various samples of the same material, such as a polyimide film, can be used to prepare the plot. The polyimide film samples are loaded, each with a different filler loading of carbon black mixture. The filler loadings should increase for each sample, until a statistically significant number of samples with different filler loadings have been obtained, for example, from about 5 to about 25 samples with different filler loadings should be provided. The conductivity of each filler loaded material is then measured and plotted on a graph of filler loading versus conductivity. With embodiments of the present invention, such a plot will be linear. Such a plot can be useful in determining the filler loading in order to tailor the conductivity.

The electrostatographic copying process described herein is well known and is commonly used for light lens copying of an original document. Analogous processes also exist in other electrostatographic printing applications such as, for example, digital laser printing where a latent image is formed on the photoconductive surface via a modulated laser beam, or ionographic printing and reproduction where charge is deposited on a charge retentive surface in response to electronically generated or stored images. The coatings are useful in all such applications.

All the patents and applications referred to herein are hereby specifically, and totally incorporated herein by reference in their entirety in the instant specification.

The following Examples further define and describe embodiments of the present invention. Unless otherwise indicated, all parts and percentages are by weight of total solids.

EXAMPLES

Example I

Various amounts of carbon blacks VULCAN® XC72 and REGAL 250R®, barium titanates and mica were incorporated into TERATHANE® 650 polyether urethane to study the effects of fillers on resistivity, dielectric constant and dielectric strength.

Several compounds were formulated with TERATHANE® 650 and typical compounds. Both these carbon blacks were compounded into TERATHANE® 650 using a three roll mill. Different levels of carbon black were studied.

Figure 4:
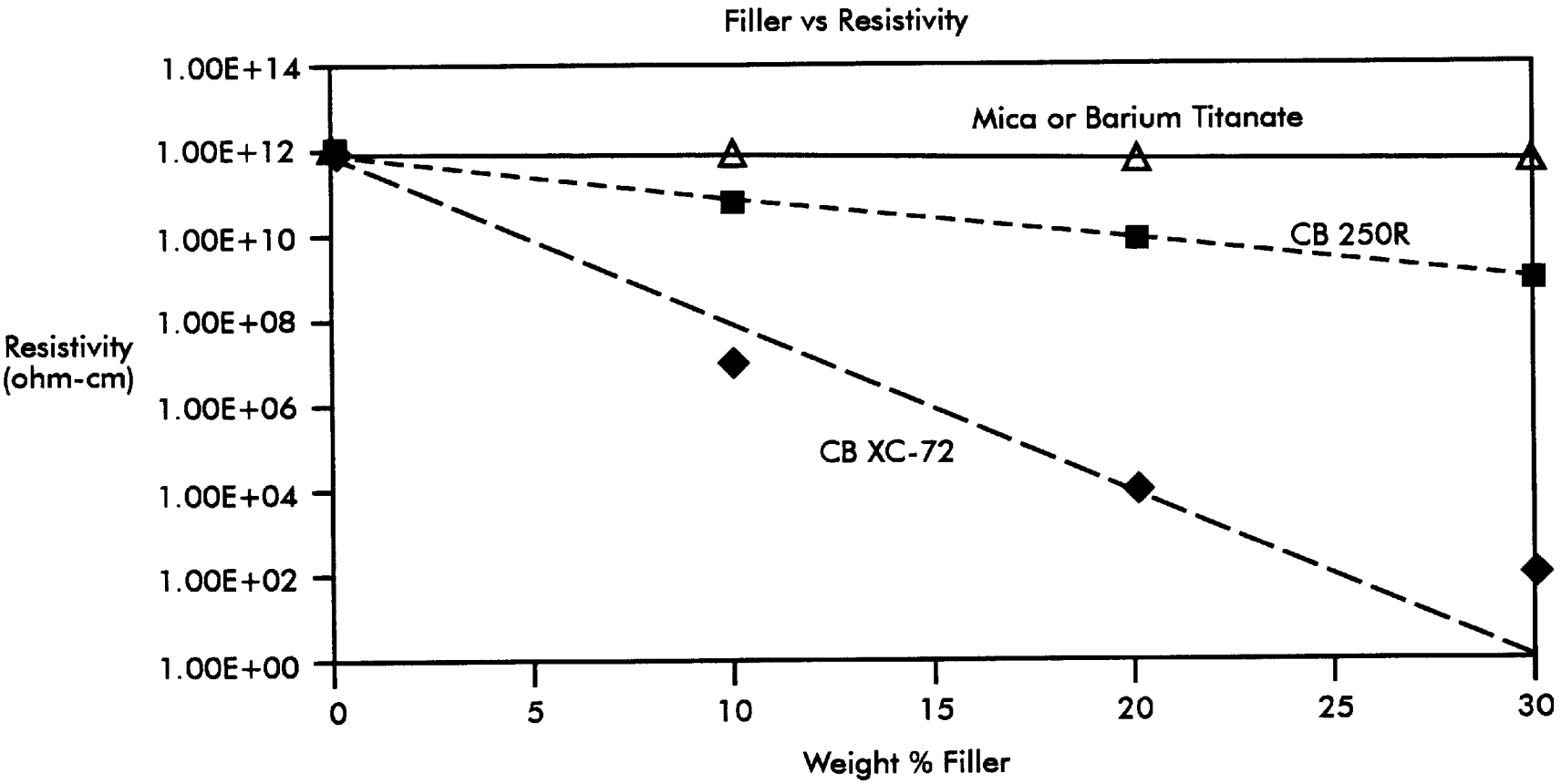
FIG. 4 depicts a graph of weight percent of filler versus resistivity (ohm-cm) for mica or barium titanate, CARBON BLACK 250R® and CARBON BLACK XC-72®.

FIG. 4, a graph of weight percent of filler versus resistivity (ohm-cm), demonstrates that high structured blacks like VULCAN® XC72 have steep resistivity slopes and that REGAL 250R®, a low structure black, has lower resistivities at increased filler loadings. The desired state is a combination of the two particles which yields a balanced controlled conductivity at medium levels of filler loading. This enables improved mechanical properties.

FIG. 4 also demonstrates that higher loadings of mica and barium titanate used in the formulation do not change the resistivity. This enables formulations for high dielectric strength and high dielectric constant to be compounded without changing resistivity.

Example II

Mixed Carbon Blacks

Figure 5:
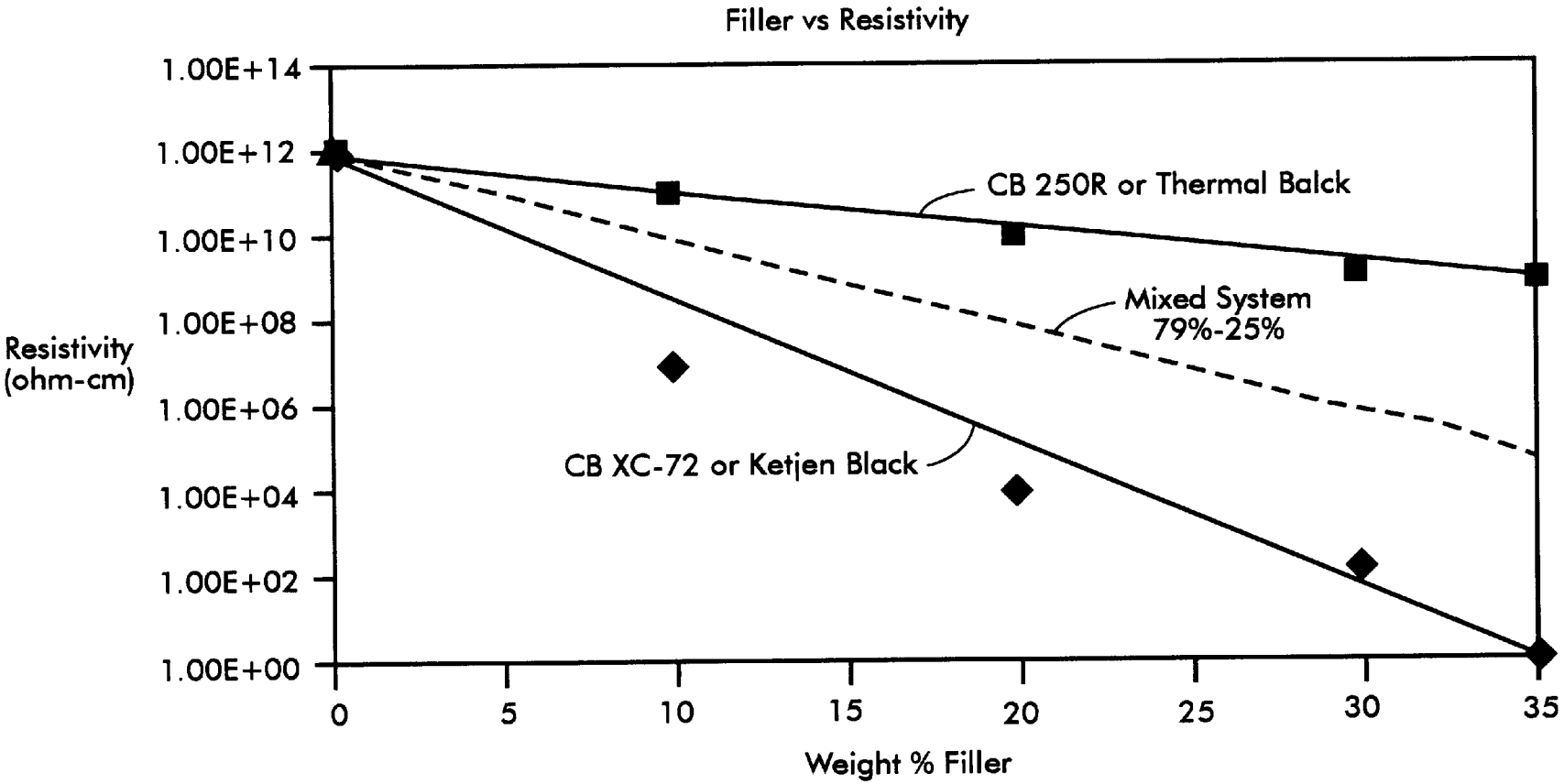
FIG. 5 depicts a graph of weight percent of filler versus resistivity (ohms-cm) for CARBON BLACK 250R® or THERMAL BLACK®, CARBON BLACK XC-72® or KETJEN BLACK®, and a combination of THERMAL BLACK® and KETJEN BLACK®.

A coating dispersion can be made by mixing KETJEN BLACK® (a high structure carbon black) and THERMAL BLACK® (a low structure carbon black). In order to fulfill all of the requirements of processing, mechanical properties, electrical properties and chemical properties, a combined mixture of two varieties of carbon blacks is desired. Based on optimum packing factors, a mix ratio of 75% KETJEN BLACK® and 25% THERMAL BLACK® is estimated to yield a balanced formulation. A mixed carbon black system can be formulated into a urethane such as TERATHANE® 650 and the electrical properties described in FIG. 5 are estimated to result. FIG. 5 is a graph of weight percent of filler versus resistivity (ohms-cm) for CARBON BLACK 250R® or THERMAL BLACK®, CARBON BLACK XC-72® or KETJEN BLACK®, and a combination of THERMAL BLACK® and KETJEN BLACK®. It is clear from the graph that a mixed system containing THERMAL BLACK® and KETJEN BLACK® is estimated to result in a controlled conductivity within a desired range.

While the invention has been described in detail with reference to specific and preferred embodiments, it will be appreciated that various modifications and variations will be apparent to the artisan. All such modifications and embodiments as may readily occur to one skilled in the art are intended to be within the scope of the appended claims.

We claim:

1. A transfer member comprising a polymer and a mixture of more than one variety of carbon black, wherein said polymer is selected from the group consisting of polyimide, urethanes, and silicone elastomers, and wherein said carbon black mixture comprises a first carbon black having a particle size of from about 1 micron to about 100 microns and a second carbon black having a particle size of from about 1 submicron to about 1 micron, and wherein said first carbon black has a particle size different to the particle size of said second carbon black.

2. A transfer member in accordance with claim 1, wherein said carbon black mixture comprises a first carbon black having a surface resistivity of from about of $10^{-1}$ to about $10^{3}$ ohms-cm and a second carbon black having a surface resistivity of from about $10^{3}$ to about $10^{7}$ ohms-cm.

3. A transfer member in accordance with claim 1, wherein said carbon black mixture comprises a first carbon black having a dielectric constant of from about 50 to about 500K and a second carbon black having a dielectric constant of from about 4 to about 600 K.

4. A transfer member in accordance with claim 1, wherein said carbon black mixture comprises a first carbon black and a second carbon black, wherein a first carbon black has a particle shape different from a particle shape of a second carbon black.

5. A transfer member in accordance with claim 1, wherein said transfer member is in the form of a sheet, belt or film.

6. A transfer member in accordance with claim 1, wherein said polymer is a polyimide.

7. A transfer member in accordance with claim 1, wherein said transfer member comprises a substrate and thereover, a coating comprising a polymer and a mixture of more than one carbon black.

8. A transfer member in accordance with claim 7, wherein said substrate is in the form of a cylindrical roll.

9. A transfer member in accordance with claim 8, wherein said polymer is selected from the group consisting of urethanes and silicone elastomers.

10. A transfer member in accordance with claim 7, further comprising at least one intermediate layer positioned between said substrate and said coating.

11. A transfer member in accordance with claim 1, wherein said transfer member has a surface resistivity of from about $10^{7}$ to about $10^{13}$ ohms/sq.

12. A transfer member in accordance with claim 1, wherein said transfer member has a hardness of from about 45 to about 65 Shore A.

13. A transfer member in accordance with claim 1, wherein said transfer member further comprises a conductive filler dispersed therein.

14. A transfer member in accordance with claim 13, wherein said conductive filler is selected from the group consisting of metal oxides, metal carbides, metal nitrides, metal oxide composites, and mica.

15. A transfer member in accordance with claim 14, wherein said conductive filler is selected from the group consisting of barium titanate, mica and mixtures thereof.

16. A transfer member in accordance with claim 1, wherein said transfer member is in the form of an intermediate transfer belt and wherein said polymer is a polyimide.

17. A transfer member in accordance with claim 1, wherein said transfer member is in the form of a bias transfer member and wherein said polymer is selected from the group consisting of urethanes and silicone elastomers.

18. A transfer member in accordance with claim 1, wherein said polymer is a polyimide, and wherein said transfer member further comprises barium titanate and mica.

19. A transfer member in accordance with claim 1, wherein said mixture of carbon black comprises a high structure carbon black a low structure carbon black.

20. A transfer member in accordance with claim 1, wherein said mixture of carbon black comprises high oil absorption carbon black and low oil absorption carbon black.

21. A transfer member in accordance with claim 1, wherein said mixture of carbon black comprises a first carbon black having an oil absorption number of from about 72 to about 350 cc/100 g, and a second carbon black having an absorption number of from about 10 to about 50 cc/100 g.

* * * * *